US006502363B1

(12) United States Patent
Roth

(10) Patent No.: US 6,502,363 B1
(45) Date of Patent: Jan. 7, 2003

(54) APPARATUS FOR STABILIZING A CHANNEL MEMBER

(76) Inventor: Steven A. Roth, P.O. Box 0933, Alamo, CA (US) 94507

( * ) Notice: Subject to any disclaimer, the term of this patent is extended or adjusted under 35 U.S.C. 154(b) by 0 days.

(21) Appl. No.: 09/841,647

(22) Filed: Apr. 24, 2001

(51) Int. Cl.[7] ..... E04C 3/30

(52) U.S. Cl. ..... 52/730.6; 52/731.7; 52/714

(58) Field of Search ..... 52/730.6, 731.7, 52/712, 714

(56) References Cited

PUBLICATIONS

PP. 83 & 87 of the Power–Strut Engineering Catalog, Copyright 1987, 1992, 1994, made available by Grinnell. Corporation and on pp. 84, 86, and 90 of the B–Line Strut Systems Engineering Catalog (BL2R).
Copyright 1985 by B–Line Systems, Inc. p. 108 of the Power–Strut Engineering Catalog.

*Primary Examiner*—Carl D. Friedman
*Assistant Examiner*—Nahid Amiri
(74) *Attorney, Agent, or Firm*—Thomas R. Lampe

(57) ABSTRACT

An attachment member having an end wall and side walls is positioned at the end of an elongated channel member and fastened to the channel member. Openings formed in the attachment member are used to accommodate bracing for stabilizing and restricting movement of the channel member when the channel member is suspended.

16 Claims, 5 Drawing Sheets

APPARATUS FOR STABILIZING A CHANNEL MEMBER

TECHNICAL FIELD

This invention relates to apparatus employed in the building construction industry and more particularly to apparatus for stabilizing a suspended channel member of the type employed, for example, to hold or support pipes, conduits or other components of a building from building structure.

BACKGROUND OF THE INVENTION

Channel members or struts are commonly used in the building construction industry for a variety of purposes. Channel members are commonly used, for example, with hanger rods, and the channel member depending from the hanger rod is commonly employed to hold or support pipes, conduits or other components of a building from a ceiling or other overhead building structure.

The typical channel member is of elongated construction and includes a channel member base and two spaced, substantially parallel channel member legs attached to the channel member base and extending therefrom. Each of the channel member legs has an inturned lip extending over an interior of the channel defined by the channel member base and the channel member legs. The channel member has two ends defining openings communicating with the channel member interior.

Many different types of hardware or fittings have been devised for use with channel members to accomplish specific objectives. Some of these devices are attached at the ends a channel member to accomplish such tasks as that of securing the channel member to a beam or other support. Representative examples of fittings are shown, for example, on pages 83 and 87 of the Power-Strut Engineering Catalog, Copyright 1987, 1992, 1994, made available by Grinnell Corporation, and on pages 84, 86 and 90 of the B-Line Strut Systems Engineering Catalog (BL2R), Copyright 1985 by B-Line Systems, Inc.

It is also known to attach end caps to the ends of channel members for such purposes as to provide a decorative appearance or to prevent concrete from entering the channel member during a concrete pour. Representative end caps are shown on page 108 of the Power-Strut Catalog indicated above and on page 87 of the B-Line Strut Systems Engineering Catalog noted above. Simple end caps are slipped over channel member ends to function as protective safety covers.

Page 108 of the Power-Strut Engineering Catalog shows a short anchor end cap which functions as a concrete insert that is positioned at an end of a channel member to block concrete from entering the end of the channel member and to provide an outwardly projecting anchor which extends upwardly through the concrete. In other words, the channel member and the short anchor end cap are positioned in situ together and are maintained together as a unit after the concrete has been poured and hardened. There is no fastener means employed in such an arrangement for allowing the short anchor end cap to function with a suspended strut or channel member to stabilize same. The type 'B' end cap shown on the same catalog page is utilized in much the same manner as the short anchor end cap.

None of the prior art fittings is for the purpose of, or suitable for, stabilizing a suspended channel member and restricting movement of the suspended channel member from a location at the end of the channel member. With conventional arrangements, stabilizing structure is connected to a channel member at a location or locations between the ends thereof. This will result in an inability to utilize the maximum effective length of the channel member as a support for support pipes, conduits or other components of a building, as well as interfere with installation of these components on the channel member.

DISCLOSURE OF INVENTION

The present invention relates to an approach for bracing a suspended channel member against movement due to earthquakes and the like while enabling the user to employ the full length of the channel member to provide support for pipes, conduits or other components of a building. Furthermore, the open end of the channel member is covered to provide a finished appearance.

The present invention encompasses a combination including an elongated channel member having a channel member base and two spaced, substantially parallel channel member legs attached to the channel member base and extending therefrom. Each of the channel member legs has an inturned lip extending over a channel member interior defined by the channel member base and the channel member legs. The channel member has an end defining an end opening communicating with the channel member interior.

An attachment member is provided for attaching one or more stabilizing structures or braces to the channel member when the channel member is suspended to stabilize and restrict movement of the suspended channel member.

The attachment member includes an attachment member end wall and two attachment member side walls. The attachment member is positioned at the end of the channel member.

Fastener means fastens the attachment member to the channel member. The attachment member end wall substantially covers the end opening and the attachment member side walls are disposed alongside portions of the channel member legs.

Other features, advantages and objects of the present invention will become apparent with reference to the following description and accompanying drawings.

MODES FOR CARRYING OUT THE INVENTION

Figure 1:
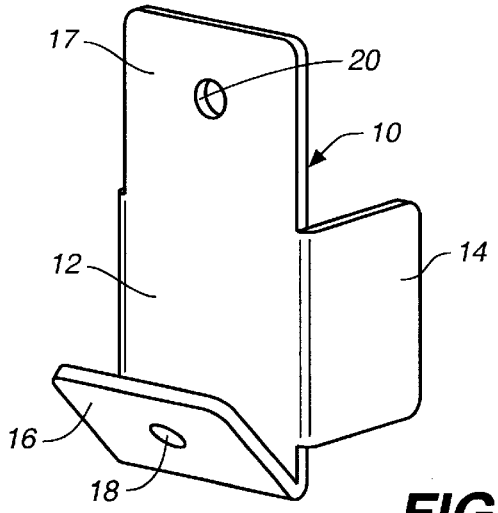
FIG. 1 is a perspective view of an embodiment of an attachment member constructed in accordance with the teachings of the present invention.
Figure 2:
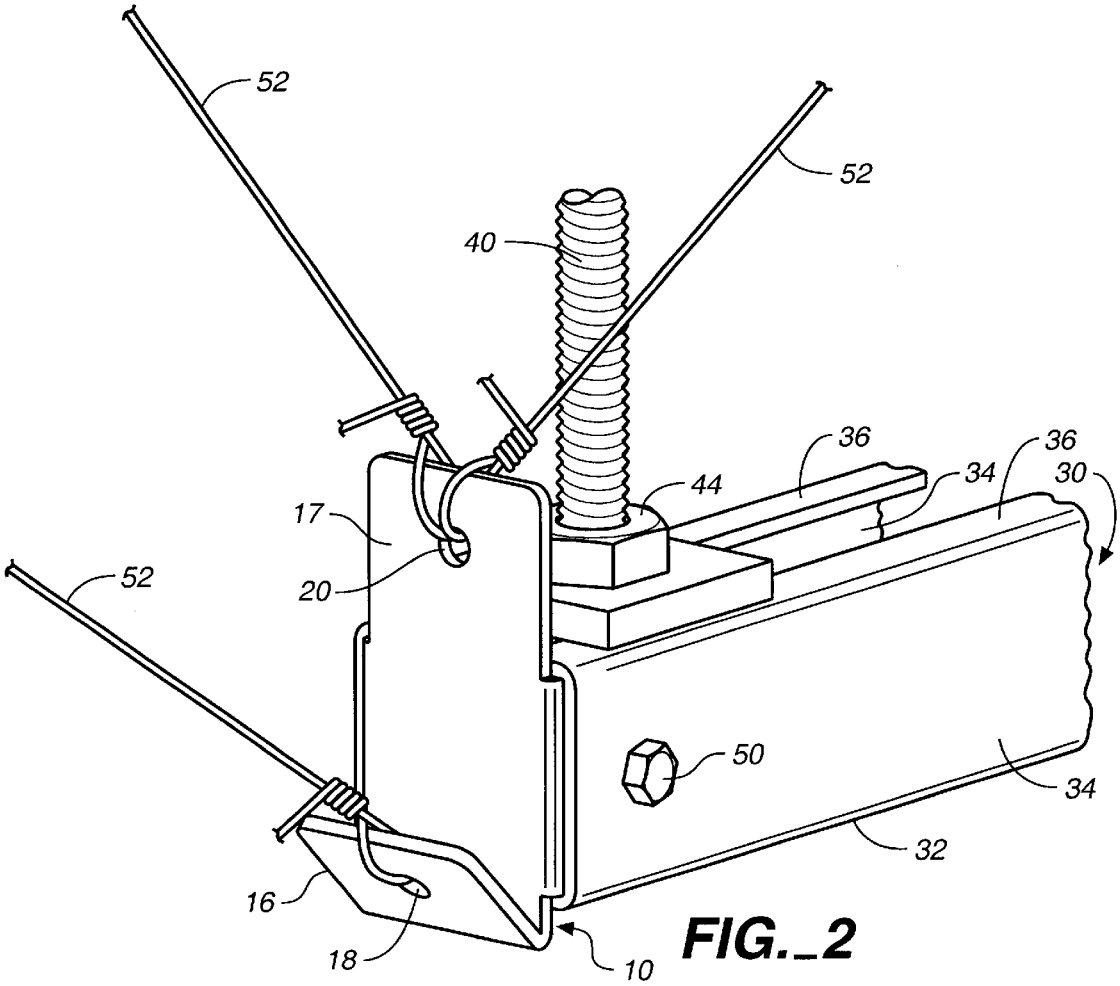
FIG. 2 is a perspective view illustrating the attachment member fastened at an end of a channel member and connected to stabilizing structures in the form of wire bracing.

Referring now to FIGS. 1 and 2, an attachment member constructed in accordance with the teachings of the present invention is designated by reference numeral 10. Attachment member 10 is of integral construction, being suitably formed of sheet metal. Attachment member 10 includes an attachment member end wall 12 and two attachment member side walls 14 of identical configuration. In the figures only one of the side walls 14 can be seen in its entirety; however, each of the side walls 14 projects orthogonally from end wall 12 and the side walls 14 are parallel to one another.

A projection 16 having an opening 18 projects from the bottom of the end wall 12 and is angularly disposed with respect thereto as illustrated. Side walls 14 project away from one side of the end wall 12, while the projection 16 projects from the opposed side thereof.

Another projection 20 comprises an extension of end wall 12 and is disposed in the same plane as end wall 12. An opening 20 is defined by projection 17. Projections 16 and 17 project away from the rest of attachment member 10.

FIG. 2 illustrates attachment member 10 fastened in position at one end of a channel member 30, a portion of the latter being shown. The channel member 30 is of conventional construction and includes a channel member base 32 having two parallel channel member legs 34 attached thereto and extending therefrom. Each of the channel member legs has an inturned lip 36 extending over the interior of the channel member defined by the base 32 and legs 34. The ends of the channel member, including the end at which attachment member 10 is positioned, communicate with the channel member interior.

FIG. 2 shows the channel member 30 supported by a threaded hanger rod 40 in a conventional manner. In the arrangement illustrated, the hanger rod 40 passes through the channel member and through a rectangular-shaped washer 42 disposed above the channel member. Also as is conventional, a nut 44 engages the washer 42. Another nut (not shown) is threadedly engaged with the lower end of the hanger rod to secure the hanger rod in the position relative to the channel member.

When the attachment member is in the position shown in FIG. 2, the side walls 14 thereof are located inside the channel member between the lips 36 and the channel member base 32. The legs 34 and portions of the side walls 14 are parallel to one another. The end wall 12 of the attachment member abuttingly engages the end of the channel member at both the top and bottom thereof. The end wall 12 covers the open end of the channel member when the attachment member side walls are disposed alongside portions of the channel member legs. Projections 16 and 17 project away from the channel member.

Fastener means is employed to fasten the attachment member to the channel member. In FIG. 2 this fastener means is in the form of a self drilling tapping machine screw 50 which is threadedly engaged with the channel member and is in locking engagement with one of the side walls 14 of the attachment member to maintain the attachment member in position. More than one machine screw may be utilized.

To stabilize and restrict movement of the channel member suspended from hanger rod 40, stabilizing structure in the form of wire braces 52 is utilized. The lower ends of the wire braces are secured to projections 16 and 17, passing through openings 18 and 20, with the distal ends of the wire braces forming loops and being wrapped about the straight segments of the wire braces. The upper ends of the braces project to a ceiling or other overhead building structure (not shown).

Figure 3:
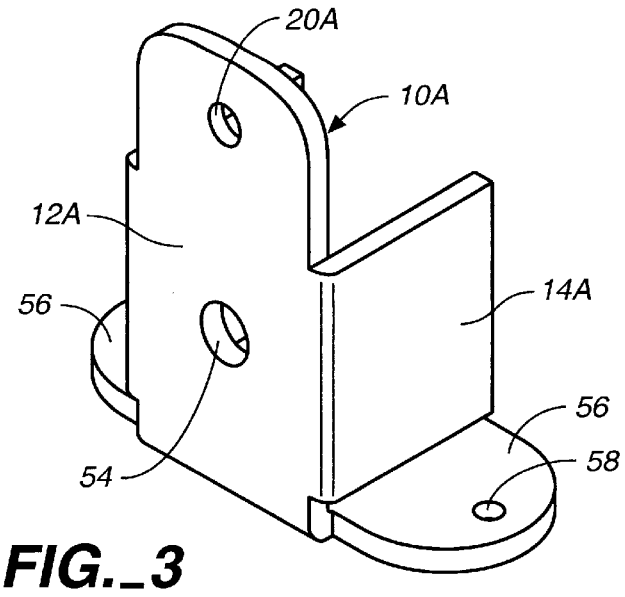
FIG. 3 is a view similar to FIG. 1 but illustrating an alternative embodiment of the invention.
Figure 4:
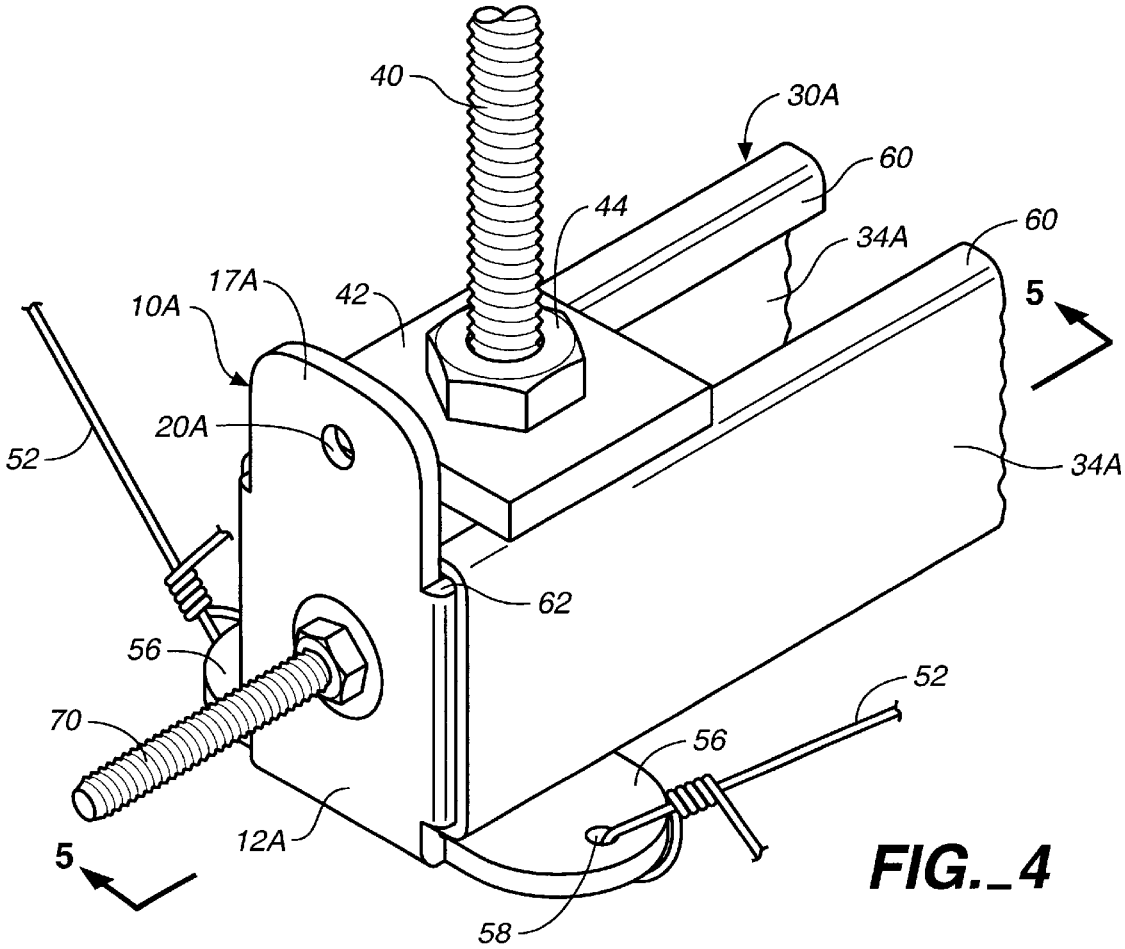
FIG. 4 is a view similar to FIG. 2 illustrating the embodiment of FIG. 3 fastened to a channel member and wire bracing.
Figure 5:
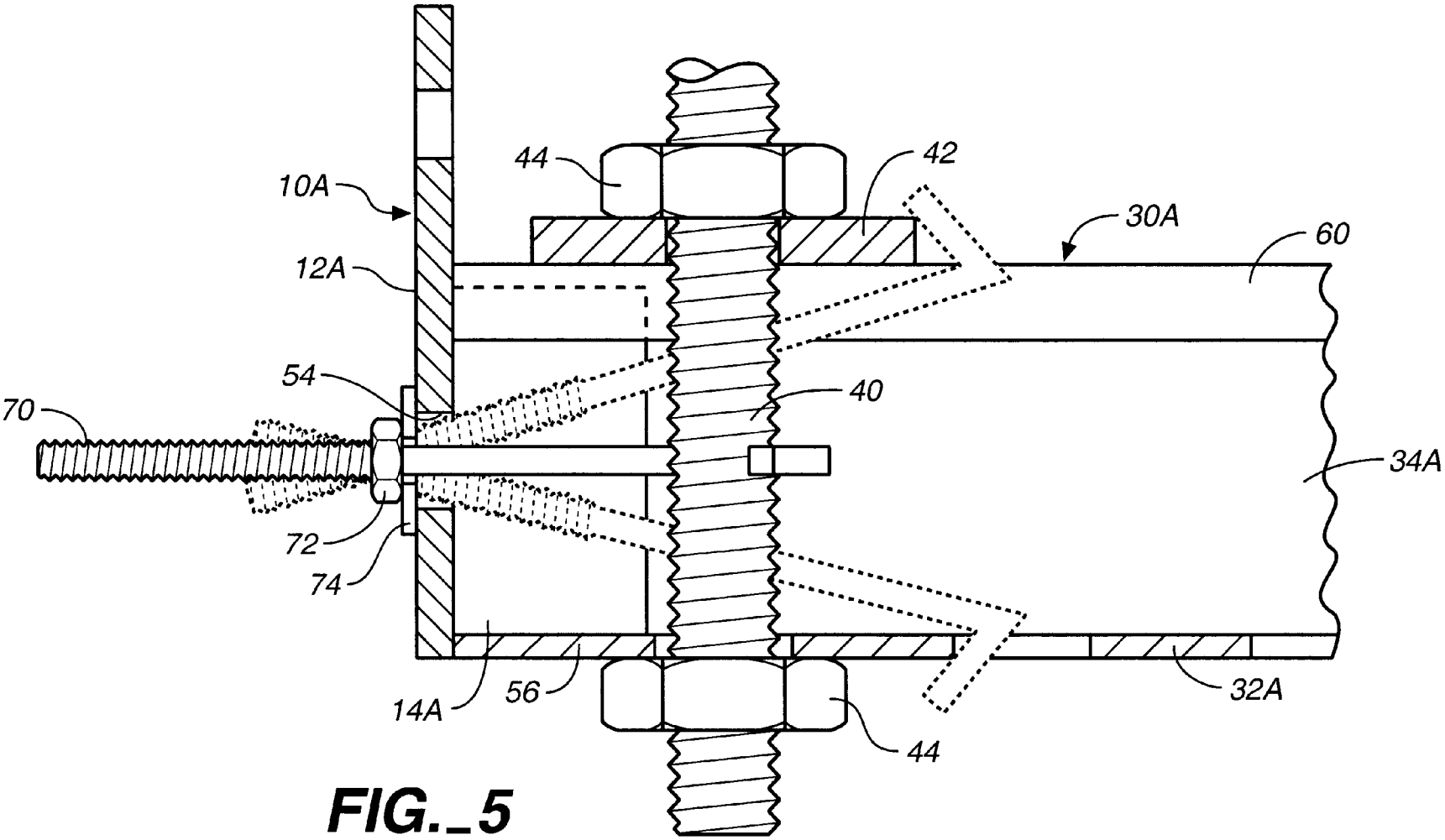
FIG. 5 is an enlarged cross-sectional view taken along the line 5—5 in FIG. 4.

FIGS. 3, 4 and 5 illustrate an alternate embodiment of the attachment member, attachment member 10A. In this embodiment of the invention, a hole 54 is formed in end wall 12A of the attachment member, the hole being spaced from opening 20A formed in projection 17A extending upwardly from end wall 12A.

In this arrangement, the bottom portion of end wall 12A is bent inwardly. Projections 56 extend from the inwardly bent bottom portion under side walls 14A. The projections 56 project from the rest of the attachment member beyond end wall 12A and side walls 14A. An opening 58 is located in each projection 56.

FIGS. 4 and 5 show attachment member 10A in position at the end of a channel member 30A which is essentially of the same construction as previously described channel member 30 but includes inturned lips 60 which extend in a downward direction at the distal ends thereof to define elongated recesses 62 extending along the length of the channel member and in communication with the channel member interior. When the attachment member 10A is in position as shown in FIGS. 4 and 5, the upper edges of the attachment member side walls 14A are located in the elongated recesses. The projections 56 project beyond the channel member legs. Wire braces 52 are passed through the openings 58 and secured to the projections 56. Likewise, if desired, other bracing may be secured to projection 17A by opening 20A.

FIGS. 4 and 5 illustrate another form of fastener means employed to fasten attachment member 10A to channel member 30A. In this arrangement, a threaded J-bolt 70 is positioned with the straight, threaded end thereof projecting outwardly from the end of the channel member through hole 54 in the end wall 12A. A nut 72 and a washer 74 are positioned about the threaded end of J-bolt 70 at the outer surface of end wall 12A. The hooked end of the J-bolt 70 is hooked onto hanger rod 40 as shown in FIG. 5 in the solid line depiction of the J-bolt. Tightening of nut 72 will pull the attachment member into tight abutting engagement with the end of the channel member. Alternatively, the J-bolt 70 may be hooked onto square washer 42 or be passed through a hole in the base of the channel member to engage the base, both of these alternative J-bolt positions being depicted by dash line renderings.

Figure 6:
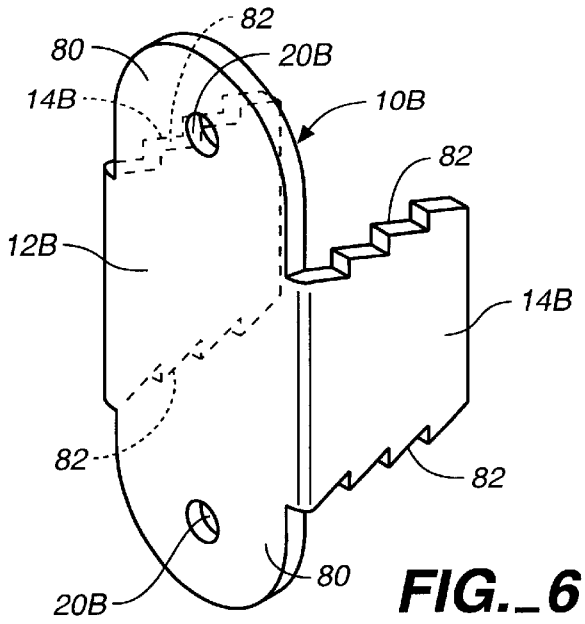
FIG. 6 is a perspective view of a third embodiment of the attachment member.
Figure 7:
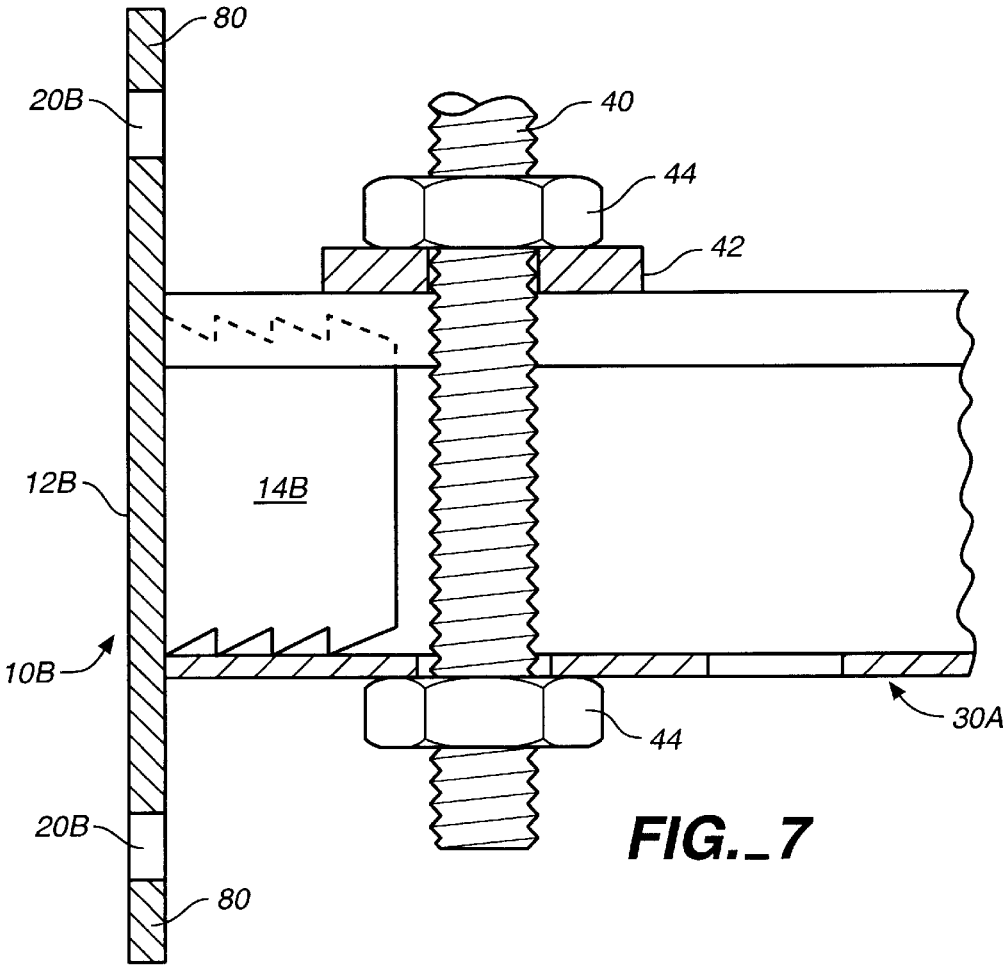
FIG. 7 is an enlarged cross-sectional view showing the attachment member of FIG. 6 attached at the end of a channel member.

FIGS. 6 and 7 show another alternate form of attachment member, attachment member 10B, in which two holes 20B are formed in projections 80 projecting from end wall 12B. Bracing can be secured to the projections by utilizing these openings. Side walls 14B are for positioning under the inturned lips of an associated channel member. In this instance, however, the upper and lower edges of the side walls 14B are serrated to form a plurality of fastener members in the form of teeth 82 having sharp edges to engage the channel member.

Figure 8:
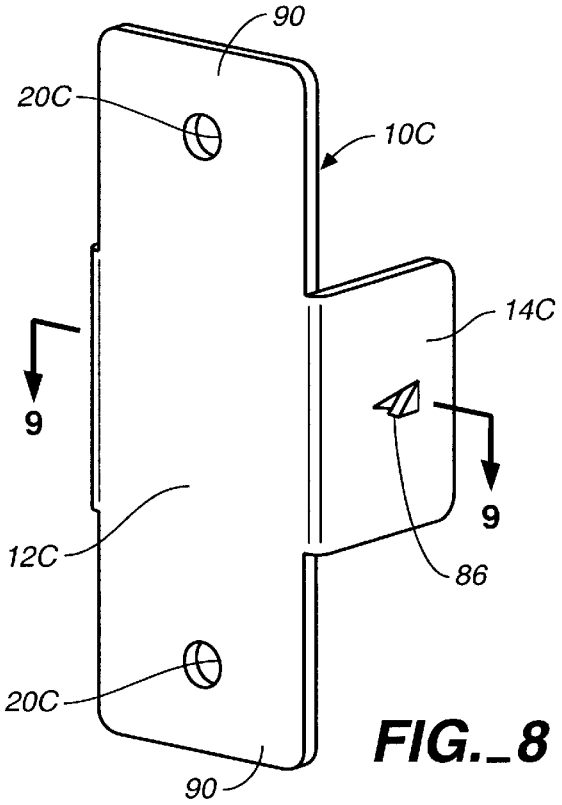
FIG. 8 is a perspective view of a fourth embodiment of the attachment member.
Figure 9:
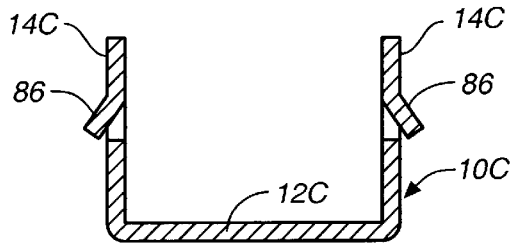
FIG. 9 is a cross-sectional view taken along the line 9—9 in FIG. 8.

FIGS. 8 and 9 show an attachment member embodiment 10C. In this embodiment fastener members in the form of sharply pointed barbs 86 are punched from side walls 14C and project outwardly therefrom. The barbs will engage the associated channel member legs to fasten the attachment member in position at the end of the channel member.

Figure 10:
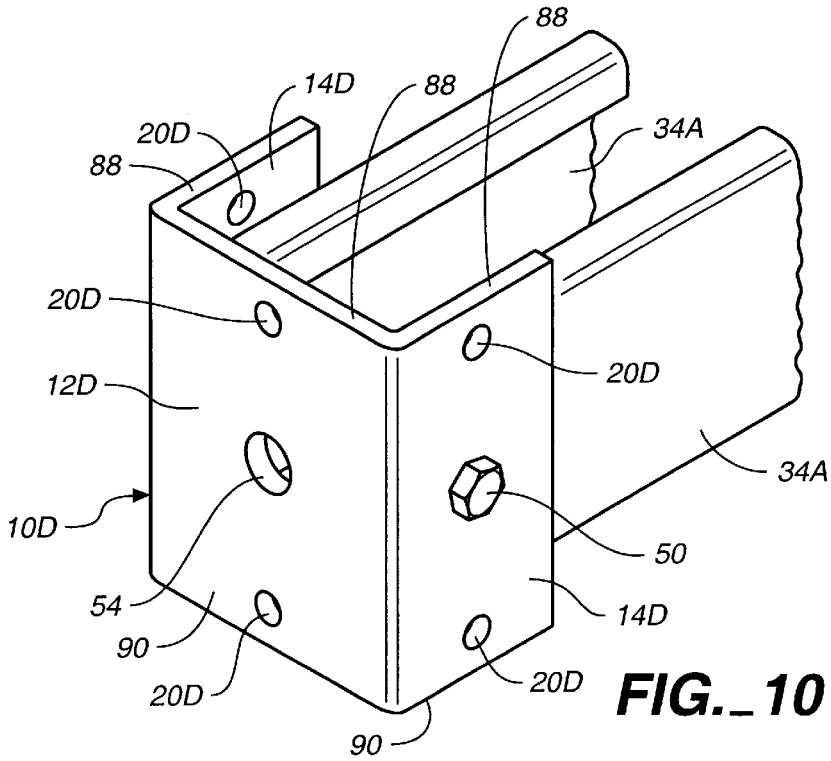
FIG. 10 is a perspective view of a fifth embodiment attached to the end of a channel member.

FIG. 10 illustrates a fourth embodiment of the invention in which the attachment member 10D has an end wall 12D having a width exceeding the width of the channel member end. Side walls 14D are integrally attached to end wall 12D and are disposed on the outside of channel member legs 34A, overlying portions thereof. A machine screw 50 can be threadedly engaged with either or both of the channel member legs and either or both of the attachment member side walls 14D to fasten the attachment member 10D to the channel member 30A. A hole 54 is located in end wall 12D for accommodating a J-bolt, if desired. The attachment member 10D has a height exceeding the height of the channel member 30A so that openings 20D formed in upper projections 88 and lower projections 90 projecting from the end wall and the side walls can be utilized to secure bracing to the attachment member.

The invention claimed is:

1. In combination:

an elongated channel member including a channel member base and two spaced, substantially parallel channel member legs attached to said channel member base and extending therefrom, each of said channel member legs having an inturned lip extending over a channel member interior defined by said channel member base and said channel member legs, and said channel member having an end defining an end opening communicating with said channel member interior;

an attachment member for attaching one or more stabilizing structures to said channel member when said channel member is suspended to stabilize and restrict movement of the suspended channel member, said attachment member including an attachment member end wall and two attachment member side walls and positioned at the end of said channel member; and fastener means fastening said attachment member to said channel member, said attachment member end wall substantially covering the end opening and said attachment member side walls being disposed alongside portions of said channel member legs, said fastener means including at least one threaded fastener extending between a channel member leg and an attachment member side wall.

2. The combination according to claim 1 wherein said attachment member defines at least one attachment member opening for receiving a stabilizing structure to connect the stabilizing structure to the attachment member.

3. The combination according to claim 1 wherein said attachment member additionally includes at least one projection integrally connected to the rest of said attachment member and extending therefrom, said at least one projection projecting away from said channel member and the rest of said attachment member.

4. The combination according to claim 3 wherein said at least one projection defines at least one projection opening for receiving a stabilizing structure to connect the stabilizing structure to the attachment member.

5. The combination according to claim 3 wherein said at least one projection is integrally attached to said attachment member end wall and projects away from said channel member and said end wall.

6. The combination according to claim 1 wherein said attachment member side walls extend into the channel member interior and are disposed below said inturned lips.

7. The combination according to claim 6 wherein said inturned lips define elongated recesses communicating with said channel member interior, said attachment member side walls having upper edges located within said elongated recesses.

8. The combination according to claim 1 wherein said attachment member side walls are disposed externally of said channel member legs.

9. The combination according to claim 1 wherein said attachment member side walls and said attachment member end wall are integrally attached and are formed from a single sheet of metal.

10. The combination according to claim 1 wherein said attachment member additionally includes a plurality of projections integrally connected to said attachment member end wall and extending therefrom, said projections projecting in directions away from said channel member and said attachment end wall.

11. In combination:

an elongated channel member including a channel member base and two spaced, substantially parallel channel member legs attached to said channel member base and extending therefrom, each of said channel member legs having an inturned lip extending over a channel member interior defined by said channel member base and said channel member legs, and said channel member having an end defining an end opening communicating with said channel member interior;

an attachment member for attaching one or more stabilizing structures to said channel member when said channel member is suspended to stabilize and restrict movement of the suspended channel member, said attachment member including an attachment member end wall and two attachment member side walls and positioned at the end of said channel member; and fastener means fastening said attachment member to said channel member, said attachment member end wall substantially covering the end opening and said attachment member side walls being disposed alongside portions of said channel member legs, said fastener means comprising a J-bolt passing through an aperture formed in said attachment member end wall.

12. The combination according to claim 11 wherein said J-bolt is connected to said channel member at a location spaced from said attachment member.

13. The combination according to claim 12 wherein said channel member defines a hole and wherein said J-bolt is positioned in said hole and is in direct engagement with said channel member.

14. The combination according to claim 11 additionally comprising a washer disposed externally of said channel member and a bolt extending through said washer and securing said washer to said channel member, said J-bolt engaging said washer.

15. The combination according to claim 11 additionally comprising an elongated member connected to said channel member and extending through said channel member interior, said J-bolt engaging said elongated member.

16. In combination:

an elongated channel member including a channel member base and two spaced, substantially parallel channel member legs attached to said channel member base and extending therefrom, each of said channel member legs having an inturned lip extending over a channel member interior defined by said channel member base and said channel member legs, and said channel member having an end defining an end opening communicating with said channel member interior;

an attachment member for attaching one or more stabilizing structures to said channel member when said channel member is suspended to stabilize and restrict movement of the suspended channel member, said attachment member including an attachment member end wall and two attachment member side walls and positioned at the end of said channel member; and fastener means fastening said attachment member to said channel member, said attachment member end wall substantially covering the end opening and said attachment member side walls being disposed alongside portions of said channel member legs, said fastener means including at least one fastener member having a sharp surface projecting from at least one of said attachment member side walls and in engagement with said channel member.

* * * * *